US007445541B2

(12) United States Patent
Patterson

(10) Patent No.: US 7,445,541 B2
(45) Date of Patent: Nov. 4, 2008

(54) POST SURGICAL CHEST SUPPORT GARMENT

(76) Inventor: Judy Patterson, 111 Evergreen Dr., Downingtown, PA (US) 19335

( * ) Notice: Subject to any disclaimer, the term of this patent is extended or adjusted under 35 U.S.C. 154(b) by 134 days.

(21) Appl. No.: 11/334,129

(22) Filed: Jan. 17, 2006

(65) Prior Publication Data

US 2006/0194509 A1 Aug. 31, 2006

Related U.S. Application Data

(60) Provisional application No. 60/644,846, filed on Jan. 18, 2005.

(51) Int. Cl.
*A41C 3/10* (2006.01)
*A41D 13/00* (2006.01)

(52) U.S. Cl. ..... 450/54; 450/57; 2/463

(58) Field of Classification Search ..... 450/54–58, 450/36–38, 86, 88, 89; 2/463, 267, 268; 602/19

See application file for complete search history.

(56) References Cited

U.S. PATENT DOCUMENTS

| | | | | |
|---|---|---|---|---|
| 5,158,541 | A * | 10/1992 | McCurley | 602/79 |
| 5,807,160 | A * | 9/1998 | Wehmeyer | 450/57 |
| 6,095,894 | A * | 8/2000 | Stevens | 450/57 |
| 6,102,772 | A * | 8/2000 | Fernandez | 450/1 |
| 6,769,955 | B1 * | 8/2004 | Fisher | 450/54 |
| 7,001,239 | B2 * | 2/2006 | Russell | 450/57 |

* cited by examiner

*Primary Examiner*—Gloria M. Hale
(74) *Attorney, Agent, or Firm*—Eugene E. Renz, Jr., P.C.

(57) ABSTRACT

This invention is directed to patients who need vertical support in the cleavage area due to symmastia repair or reconstruction of the chest cleavage for breast reconstruction after mastectomy. The support garment is designed not to support the breast or nipple area of the chest. The Y support which fits the patient close to the neck and between the breasts is attached to a full back panel using self adjusting velcro closures. This unique design creates a force much like a bow to provide constant pressure from front to back on the cleavage area only to allow scar tissue to form during the healing process. The cross link high density foam insert maintains even pressure during healing and does not lose its resiliency or permit permanent deformation.

20 Claims, 3 Drawing Sheets

POST SURGICAL CHEST SUPPORT GARMENT

This application claims the benefit of U.S. Provisional Application Ser. No. 60/644,846 filed Jan. 18, 2005.

FIELD OF THE INVENTION

The present invention relates to support garments designed to be worn during the recovery stages following breast surgery. The support garment of the present invention is characterized by unique and novel features of construction and arrangement to support the muscles and tissues disturbed during the surgery in a predetermined manner to produce the proper cleavage between the breast implants.

DESCRIPTION OF PRIOR ART

Garments of this general type are not new per se. However, none show the unique support arrangement of the present invention which supports the muscles and tissue in the cleavage area to restore proper cleavage between breast implants. For example, in U.S. Pat. No. 5,820,444 issued Oct. 13, 1998 for a POST SURGICAL BRASSIERE the focus and feature of the invention is a specifically designed midriff support band having adjustable means to provide more comfort in the midriff region and prevent downward movement of breast tissue below the breast. More specifically, the band has tension adjusting means to compensate for swelling experienced by patients in the post operative recovery period.

The midriff support gently secures the brassiere to the torso with minimal discomfort. The reduction in constriction is attributable to provision of a plurality of spaced vertical bones at strategic locations along the length of the band dividing the band into regions which are elasticized. Thus, as adjustment straps are drawn together for fastening, the stretch of the support band will occur predominantly in the back and side sections where tension will be greatest leaving the frontal regions relatively loose fitting. Thus, the primary object of this patent is comfort to the wearer's midriff region by the novel band design. The patent is devoid of any disclosure of a support system for restoring the cleavage area between breast implants.

U.S. Pat. No. 6,402,586 issued Jun. 11, 2002 for POST SURGICAL BRA, is also of interest to the extent that it is directed to a brassiere for augmented breasts. The feature of this patent is aimed at comfort and does not incorporate any breast supporting structure such as elastic panels and underwires. This patent is likewise devoid of any teaching or suggestion of a support garment having a compression pad for selectively applying predetermined pressure in the cleavage area to aide in shaping the breast area in this region.

The design patents listed below are of interest to the extent that they disclose bras in this field but clearly do not teach the structural details and functional advantages of the present invention:

| | | | |
|---|---|---|---|
| Furlong | MASTECTOMY BRA PORTION | Dec. 10, 2002 | U.S. Pat. No. D466,673S |
| Swanger | THERAPEUTIC BRA | Aug. 21, 2001 | U.S. Pat. No. D446,629 |

BACKGROUND OF THE INVENTION

The support garment of the present invention is designed generally for two medical conditions, breast augmentation or breast augmentation complications and breast reconstruction following a mastectomy.

In the case of breast augmentation surgery, which can result in a condition known as symmastia (also known as uniboob, bread loafing, etc), the muscles and tissues are damaged and the implants do not remain in their designated surgical position. A remedial surgical procedure is required to repair the symmastia. The tissues and muscles in the cleavage area must then be held securely in place until the tissues and muscles have healed.

Symmastia happens when the chest muscles are cut during the breast augmentation surgery. To repair the area, the surgeon needs to reattach the muscle with permanent and/or semi-permanent sutures. During the healing process, support of the area is greatly enhanced with the wearing of the support garment of the present invention while scar tissue forms.

In the case of breast cancer, one or both breasts are surgically removed in a procedure known as a mastectomy. Sometimes an inflatable implant may be used for cosmetic reasons, which is gradually filled to produce the desired breast shape and size over a period of many months. It has been found that the tissues and muscles damaged in the surgical procedure, particularly in the cleavage area between the breasts, needs to grow and be shaped during the post surgical recovery period and, in some instances, regenerate in a manner which leaves a clear cleavage definition. Like the healing process for symmastia, support of the area is greatly enhanced with the wearing of the support garment of the present invention while scar tissue forms for mastectomy patients as well.

SUMMARY OF THE INVENTION

In view of the above, the objective of the present invention is to provide a medical garment that provides secure chest support characterized by unique and novel features of design, construction and operation for use by patients during the recovery period following breast surgery to aide in shaping the breast area as well as supporting the muscles and tissues. More specifically, the garment of the present invention provides support of the cleavage area by selectively applying predetermined and surgeon recommended pressure on the repaired cleavage tissues and muscles. In one form of the invention, an elongated "non-roll elastic compression pad which can be mounted permanently on the inside of the front panel of the support garment and is of a predetermined configuration and shape to compress the muscles and tissues in the cleavage area during the healing process. The compression pad can be constructed in a manner which permits it to be mounted permanently or removed. In addition, it can be interchanged with a variety of covered compression foam pads. More specifically, the compression pads are preferably made of a plastic foam material and have variable thickness and width so that the proper size can be used to provide the optimum compression as determined by the patient's surgeon without adding undue weight. In accordance with a preferred embodiment of the invention, the compression pad is a truncated trapezoidal cross section with slanted side walls that function as a shaping surface during the recovery period. In the preferred arrangement, the thickness of the pad is also variable to better control the desired pressure as determined by the surgeon. It also may be selectively varied if warranted by the surgeon depending on the physical attributes of the patient.

BRIEF DESCRIPTION OF THE INVENTION

These and other objects of the present invention and the various features and details thereof are hereinafter more fully set forth with reference to the accompanying drawings, wherein;

FIG. 1 is a front elevational view of the support garment in accordance with the present design and new invention;

FIG. 1*a* is an enlarged sectional view taken on lines 1*a*-1*a* of FIG. 1 showing the compression pad mounted in the inside face of the front panel of the garment;

DESCRIPTION OF THE PREFERRED EMBODIMENTS

Figures 1, 1A, 2:
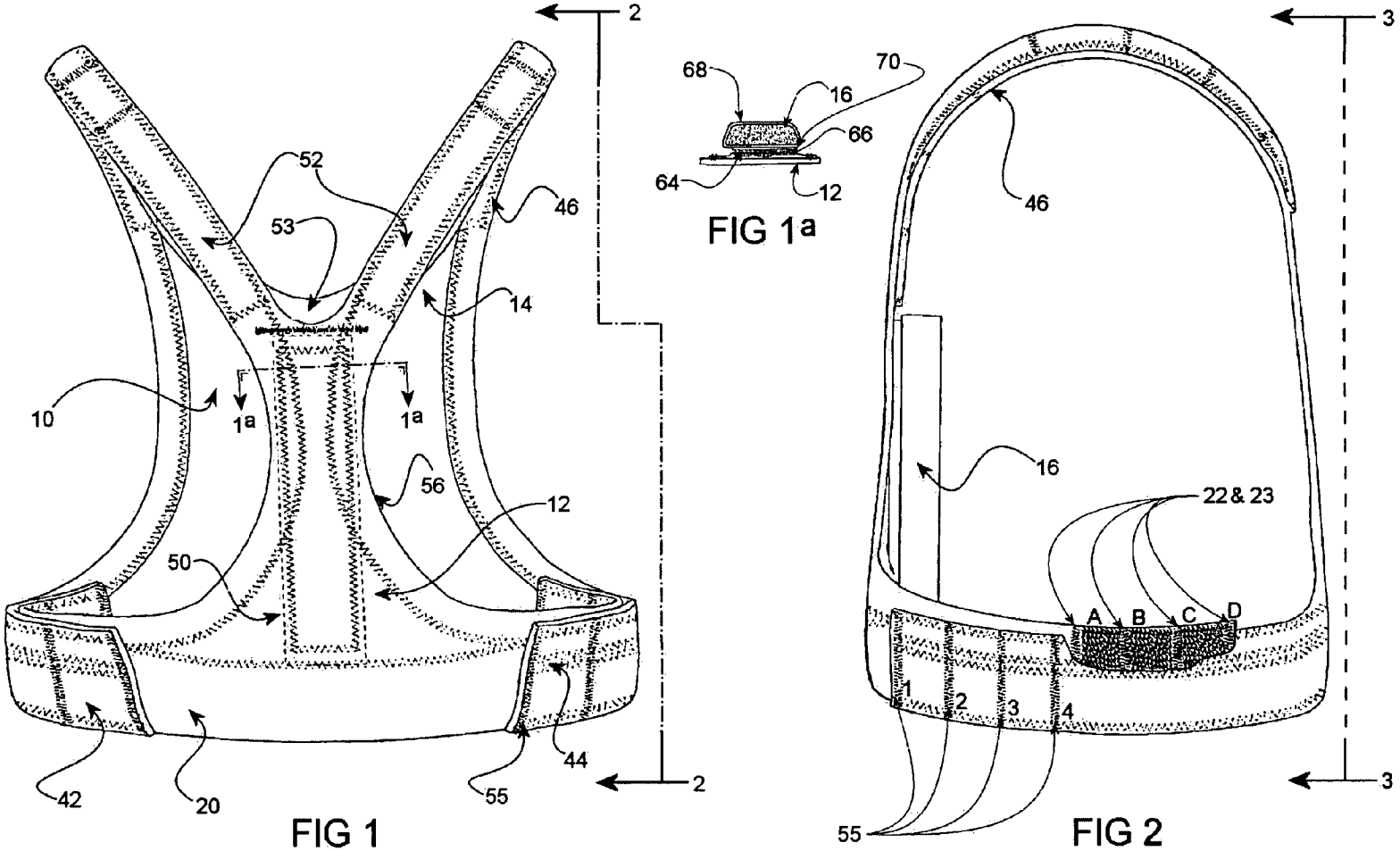
FIG. 2 is a side elevational view of the support garment showing the interior compression pad in place.
Figure 4:
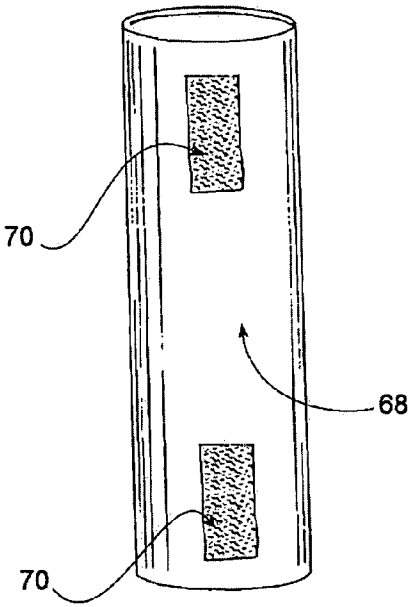
FIG. 4 shows the cover for the compression made of flexible soft material for housing the compression pad.

Referring now to the drawings and particularly FIGS. 1-5 thereof, there is illustrated a first embodiment of support garment embodying the invention generally designated by the numeral 10. The novel and unique feature of the invention is its specific design for medical remedial purposes to maintain and secure the cleavage area by utilizing a "thong" design which holds a compression pad in place and under pressure in the patient's cleavage area during the healing process following surgery.

Considering the support garment, the assembly consists essentially of three (3) components, a front panel (12), a rear panel or back panel (14) and a compression pad assembly (16). The front panel (12) Is generally of an "X" shaped configuration comprising a front midriff band portion (20) which partially encircles the user across the front of the body below the breast area and under the having terminal end portions (22) with a "hook and loop" fastener 23 on the outer face of the front band portion 20. The fabric does not cover any part of the breast itself but supports the inner area of the cleavage and lower area under the breast. Within the front panel 12 is a built in "Y" support. Three (3) rows of one inch wide non-rolled elastic are sewn together for strength and then attached to the lower "Y" of the support garment. For added support and shaping, various inserts of foam are then pushed through the sleeve of the lower "Y" to custom fit the garment for each patient's post surgery needs. The front panel (12) "V" neck design along with the wide lower band 20 creates a harness effect on the patient which allows continuous pressure and support on the center of the chest wall. The front panel 12 is a "Y" with two upward extending vertical arms 52 forming a sharp V from the apex 53 at the top of the vertical section of the "Y" and continuing down the vertical to the bottom which is terminated with two horizontal and opposing extending arms 20 and 22. These triangularly shaped portion 50 having straps 52 extending from the apex 53 of the panel outwardly to define a "V" configuration. The outer face of the terminal ends 22 of the front band portion 20 are provided with "hook and loop" hooks so that the band can be snugly fitted around the midriff of a user and engaged around the body in the manner shown.

The rear panel (14) has a full coverage back portion including two midriff bands 42, 44 which is necessary to give total support of the "Y" shaped configuration of the front panel 12. The rear panel 14 extends upwardly from the rear midriff band 40 of a generally rectangular shape. The rear panel 14 has a midriff band portion 40 which includes terminal end portions 42 with a "hook and loop" fastener 44 on the inner face of the end portions 42 to permit secure attachment with the terminal end portions 22 of the front panel 12 (see FIG. 2). Shoulder straps 46 extend from the corners of the back portion 14, each strap length extends over the shoulders of the wearer to the front of the chest as shown in FIG. 2.

The front and rear shoulder straps (52, 46) are designed to be locked in an overlapping fashion by a "hook and loop" fastener. The straps (52, 46) are designed to be easily adjustable by the wearer to provide a snug yet comfortable fit. The terminal ends of the straps (52, 46) are stitched at a plurality of spaced selected locations (55) so that the wearer can easily trim them if the overlap is too great without affecting the garments integrity. The sides of the triangular front panel 12 are gently curved as at (56) to conform generally to the actual breast shape.

Figure 5A:
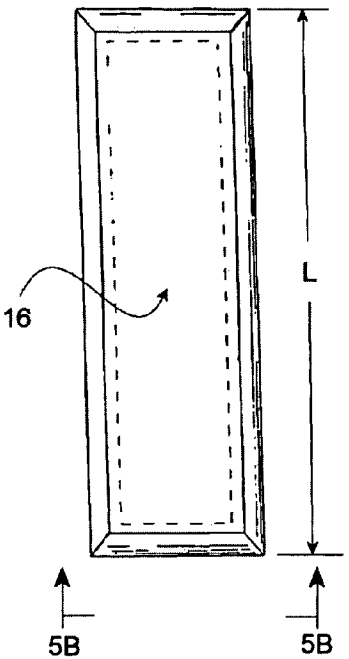
FIG. 5 is a top plan view of the compression pad assembly.
FIG. 5B is an end elevational view of the compression pad assembly as viewed along lines 5B-5B of FIG. 5A.
Figure 5B:
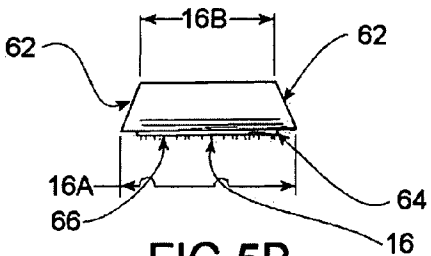
Figure 3:
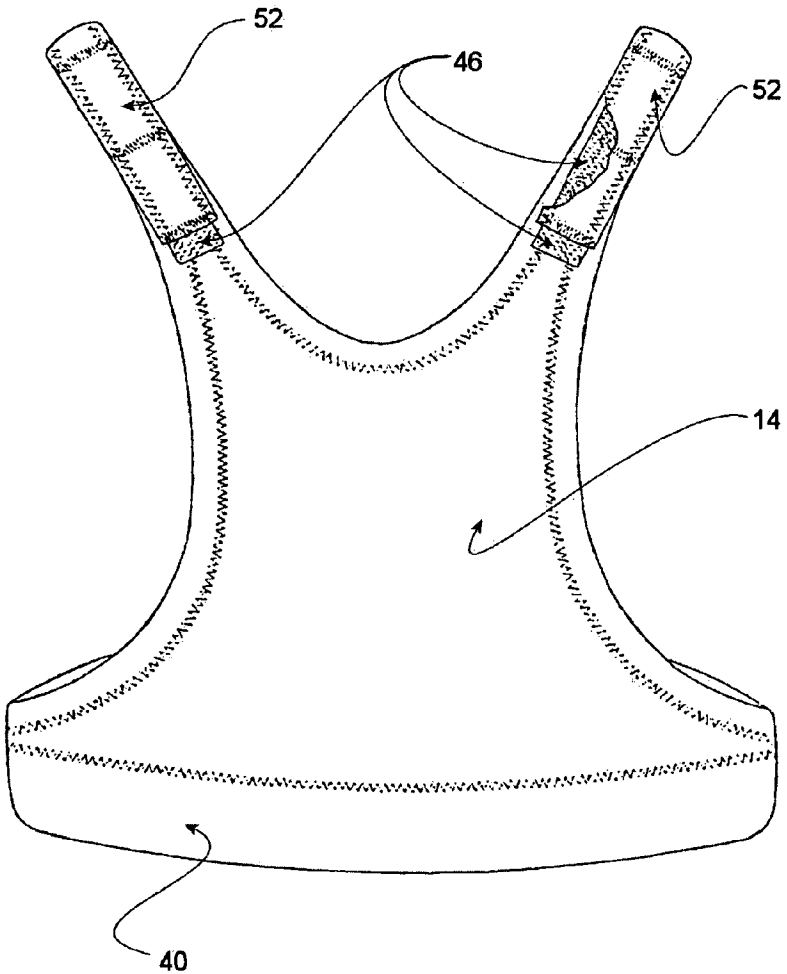
FIG. 3 is a back elevational view of the support garment of the present invention.

The assembly also includes an elongated compression pad assembly (16) (cloth over plastic foam) which is illustrated in FIG. 5B and is of a trapezoidal cross section to define upwardly converging sides (62, 62) as shown in FIG. 5B. The larger bottom face 16*a* has the hook and loop fastener 70 to secure the pad to the inside of the front panel. The smaller face 16*b* confronts and engages the cleavage area when the garment is in place. The compression pad is constructed of plastic foam in the present instance that is inserted in a cloth material tube 68 shown in FIG. 4 to make the assembly in FIG. 5B.

This pad with the cloth overlay or tube may be sewn permanently to the inner side of the front panel of the support garment or it may be made to be removable and interchangeable as with the following descriptions. The base (64) FIG. 5B of the pad assembly (16) mounts to a "hook and loop" fastener (70) so that the pad may be removably mounted inside of the front panel in the position shown in FIG. 1 and FIG. 2. The pad is of a predetermined length (L) to span the cleavage area between the breasts and is designed to press against the muscles and tissues in the cleavage area during the healing process. The removable pad can also be constructed in a variety of widths to better aid in the healing process to allow for various wearer size considerations. The width can be varied as determined by the wearer comfort and/or recommendation of the surgeon.

Figure 7:
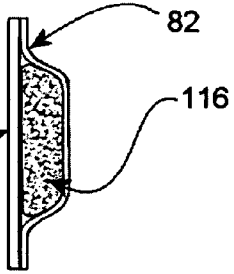
FIG. 7 is an enlarged sectional view taken on lines 7-7 of FIG. 6.
Figure 6:
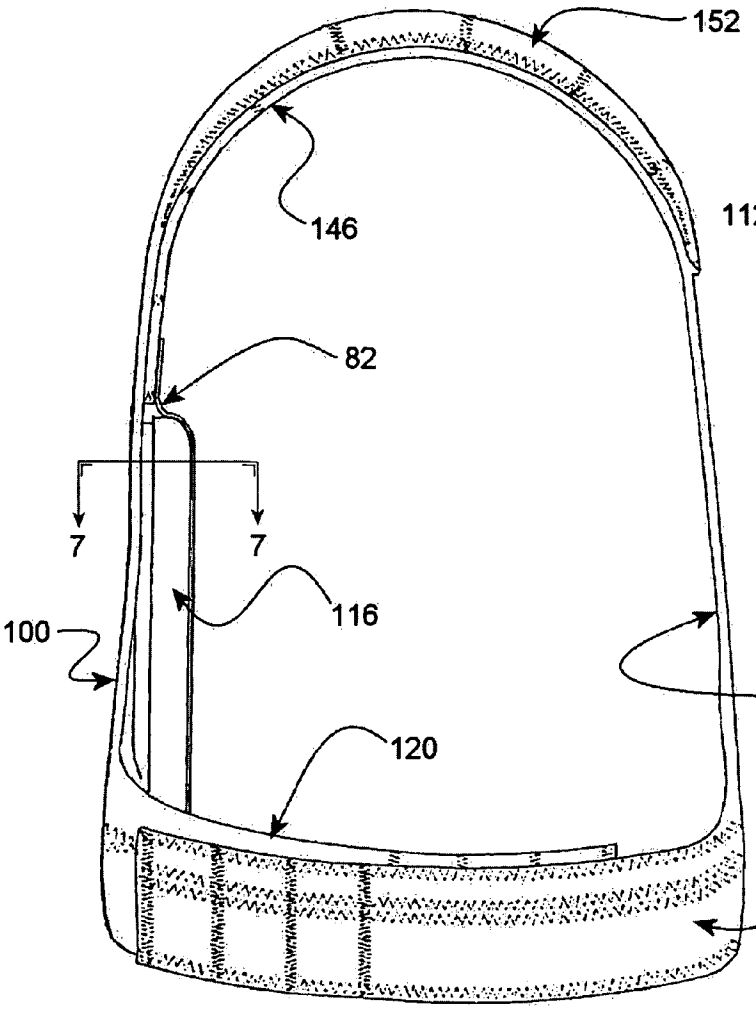
FIG. 6 is a side elevational view of another embodiment of support garment in accordance with the present invention.

There is shown in FIGS. 6-7 a modified version of support garment in accordance with the present invention. The basic components are generally the same as in the principal embodiment described above and therefore numeral designations for this embodiment are as used in the protective garment shown in FIGS. 1 through 5 inclusive but in the hundred series. Thus, the support garment generally designated by the numeral 100 comprises front and rear panels 112, 114 each having front and rear shoulder straps 152, 146, midriff bands 120, and 122 which are detachably secured in overlapping relation to press the compression pad 116 with a predetermined pressure in the region of the cleavage area when worn. The shoulder straps and midriff bands are selectively adjustably to vary the pressure in the manner described above. Further, the shoulder straps and midriff bands can be provided with indicia such as numbers and letters at the stitch locations 55 (see FIGS. 1 and 6) so that the user can maintain generally the same pressure applying relation from one use to the next. The indicia also are helpful in making slight adjustments to increase or decrease the pressure from time to time.

In accordance with this version of the support garment, the pressure pad 116 which is also of generally trapezoidal shape is permanently held in place on the inside surface of the front panel 112 by a housing 82 made of cloth which can be sewn in place so that the compression pad 116 overlies the cleavage area of the user.

Even though particular embodiments of the invention have been illustrated and described herein, it is not intended to limit the invention and changes and modifications may be made therein within the scope of the attached claims.

What is claimed is:

1. A support garment adapted to be worn by a patient following breast surgery comprising:

front and rear panels;

said front panel having an inner surface;

a compression pad mounted on the inner surface of the front panel to confront the cleavage area of the user;

each of the front and rear panels having upper extensions defining shoulder straps;

said shoulder straps each having a means for detachably securing said shoulder straps in overlapping relation thereto to snugly fit about the user's shoulders;

midriff band portions adjacent a lower edge of each of the front and rear panels;

each midriff band portion having a means for snugly fitting the garment at the midriff area of the user;

wherein said shoulder straps and said midriff band portions, when combined, support the compression pad in pressure applying relation with the cleavage area of the user; and wherein said front panel is generally "Y" shaped defining two upwardly extending arms forming the shoulder straps and forming a "V" from an apex at the top of the vertical section of the "Y" of said front panel and extending downwardly to merge with the midriff band portions.

2. A support garment as claimed in claim 1 made of stretchable material.

3. A support garment as claimed in claim 1 wherein said pad is of a predetermined length to span the wearer's cleavage area at the tail end of the vertical section of the "Y".

4. A support garment for use during the recovery stage following breast surgery comprising:

a stretchable support structure including a waist encircling band and a front panel including a cleavage covering portion with shoulder straps extending therefrom over the shoulders of a wearer to a rear panel;

said front panel including a "Y" shaped elastic strap fitting the patient close to the neck and between the breasts;

a pressure pad overlying the cleavage area on said "Y" shaped front panel; and a means for selectively adjusting the front and back panels on said waist encircling band of hook and loop fasteners to provide a relatively constant pressure on the wearer's cleavage area via the pad to thereby allow scar tissue to form during the healing process.

5. A stretchable upper torso support garment in combination with compression pads for use during the recovery stage following breast surgery comprising:

a stretchable support structure including a waist encircling band and a cleavage covering portion with shoulder straps extending therefrom over the shoulders of a wearer:

said shoulder straps extending to a back portion of the waist encircling band;

said waist encircling band, cleavage covering portion and said elastic shoulder straps constructed of an elastic stretchable material that provides a compressive force to said cleavage area of the wearer; and a set of compression pads structured for placement under said cleavage covering portions wherein each said compression pad is of a different width and thickness to provide a different level of compressive force to said cleavage area when placed under said cleavage covering portion.

6. A support garment as claimed in claim 5 wherein each pad has a cross section of a trapezoidal shape.

7. A stretchable upper torso support garment in combination with compression pads for use during the recovery stage following breast surgery comprising:

a stretchable support structure including a front panel with a cleavage covering portion thereon and a waist encircling band at a bottom edge thereof;

shoulder straps extending from said front panel over the shoulders of a wearer;

said shoulder straps extending to a back portion of the waist encircling band;

said waist encircling band, cleavage covering portion and said elastic shoulder straps constructed of an elastic stretchable material that provides a compressive force to a wearer's cleavage area; and a pressure pad on said front panel cleavage covering portion only overlying the wearer's cleavage area; and means for selectively adjusting the front and back panels along said waist encircling band to provide a relatively constant pressure on the wearer's cleavage area via the pads and said cleavage covering portion to thereby allow scar tissue to form during the healing process.

8. A support garment as claimed in claim 1 wherein said compression pad is of a trapezoidal cross section having upwardly diverging side walls.

9. A support garment as claimed in claim 5 wherein said pad is removably mounted.

10. A support garment as claimed in claim 5 wherein said pads comprise a multiple pad set of pads having different lengths, widths and thickness for interconnection to the pad.

11. A support garment as claimed in claim 5 wherein said pads are made of a high density foam to maintain even pressure during healing without losing its resilience and thereby resisting permanent deformation.

12. A support garment as claimed in claim 5 including a tubular housing for the pads made of cloth that is detachably mounted on the inner side of the front panel.

13. A support garment as claimed in claim 1 including a tubular housing for the pads made of cloth which can be permanently mounted on the inner side of the front panel.

14. A support garment as claimed in claim 5 wherein said compression pad is removably mounted by hook and loop fasteners.

15. A support garment to provide support in a wearer's cleavage area after breast reconstruction surgery comprising:

front and rear panels made of a stretchable elastic material;

each of said front and rear panels having shoulder straps with hook and loop fasteners thereon for detachably securing the shoulder straps in overlapping relation;

midriff band portions on each of said front and rear panels each having hook and loop fasteners for attaching the midriff band portions together thereby snugly fitting the garment at the midriff area;

a pressure pad overlying the wearer's cleavage area and under said front panel;

the adjustability of the shoulder straps and midriff portions with the fasteners and elastic front and rear panels all collectively providing a relatively constant pressure on the wearer's cleavage area whereby the placement of the selected pad provides a means for selectively varying compressive pressure applied to the wearer's cleavage area during the post surgical healing process.

16. A breast cleavage area compression kit comprising, in combination:

a support garment having stretchable elastic front and rear panels each with shoulder and midriff straps extending therefrom;

each of said shoulder and midriff straps having hook and loop fasteners for adjusting the shoulder and midriff straps; and a plurality of pads of various widths and thickness for selectively positioning a selected pad under the front panel to thereby only overlie the wearer's cleavage area whereby the placement of the selected pads provides a means for selectively varying the compressive pressure applied to the wearer's cleavage area during the post surgical healing process.

17. A support garment as claimed in claim 7 wherein said compression pad is of a trapezoidal cross section having upwardly diverging side walls.

18. A support garment as claimed in claim 7 wherein said pad is removably mounted on an inner surface of said cleavage covering portion.

19. A support garment as claimed in claim 7 wherein said pads comprise a multiple pad set of pads having different lengths, widths and thickness for interconnection to the pad.

20. A support garment as claimed in claim 18 wherein said pad is removably mounted on said cleavage covering portion with a hook and loop fastener.

* * * * *

UNITED STATES PATENT AND TRADEMARK OFFICE

CERTIFICATE OF CORRECTION

PATENT NO. : 7,445,541 B2
APPLICATION NO. : 11/334129
DATED : November 4, 2008
INVENTOR(S) : Patterson It is certified that error appears in the above-identified patent and that said Letters Patent is hereby corrected as shown below:

On the Title page Item (76) please delete "Judy Patterson" and insert --Judy Czop--

On the Title page Item (12) delete "Patterson" and insert --Czop--

Signed and Sealed this

Ninth Day of December, 2008

JON W. DUDAS
*Director of the United States Patent and Trademark Office*